United States Patent [19]

Coppola

[11] Patent Number: 4,717,045

[45] **Date of Patent: * Jan. 5, 1988**

[54] SYRUP SENSOR FOR DISPENSING MACHINE

[75] Inventor: Peter J. Coppola, Burlington, Mass.

[73] Assignee: Jet Spray Corp., Norwood, Mass.

[ * ] Notice: The portion of the term of this patent subsequent to Feb. 24, 2004 has been disclaimed.

[21] Appl. No.: 873,178

[22] Filed: Jun. 11, 1986

Related U.S. Application Data

[63] Continuation of Ser. No. 590,994, Mar. 19, 1984, Pat. No. 4,645,095.

[51] Int. Cl.[4] ..... B67D 5/08

[52] U.S. Cl. ..... 222/64; 340/606

[58] Field of Search ..... 137/558; 73/304 R; 307/118; 324/65 P; 340/606, 616, 620; 367/908; 222/14, 23, 40, 63–64, 66

[56] References Cited

U.S. PATENT DOCUMENTS

| | | | |
|---|---|---|---|
| 2880910 | 4/1959 | Hanson et al. | 222/65 |
| 3,643,835 | 2/1972 | Popinski | 222/56 |
| 4,182,363 | 1/1980 | Fuller | 340/620 X |
| 4,205,237 | 5/1980 | Miller | 340/620 X |
| 4,392,128 | 7/1983 | Young et al. | 340/616 |
| 4,406,382 | 9/1983 | Roth | 222/64 |
| 4,569,312 | 2/1986 | Riddell et al. | 137/558 X |

FOREIGN PATENT DOCUMENTS

| | | | |
|---|---|---|---|
| 1473088 | 11/1968 | Fed. Rep. of Germany . | |
| 2505238 | 8/1975 | Fed. Rep. of Germany . | |
| 2927066 | 1/1980 | Fed. Rep. of Germany . | |
| 1365196 | 5/1964 | France | 340/620 |
| 1061759 | 3/1967 | United Kingdom | 340/620 |
| 1130621 | 10/1968 | United Kingdom | 340/620 |

*Primary Examiner*—Joseph J. Rolla
*Assistant Examiner*—Michael S. Huppert
*Attorney, Agent, or Firm*—Wolf, Greenfield & Sacks

[57] ABSTRACT

A sensor apparatus for sensing an out-of-syrup condition in association with a machine for dispensing a beverage and in which the beverage is constituted of a syrup concentrate and water. The sensor comprises a housing having a through passage and a transverse hole which receives a cap for supporting a probe that extends partially into the through passage. The probe is preferably disposed vertically and operates on a gravity principle so that when the syrup is depleted, a gap forms and the syrup liquid essentially breaks away from the probe causing a high resistance indication that is detected.

37 Claims, 8 Drawing Figures

Fig. 3
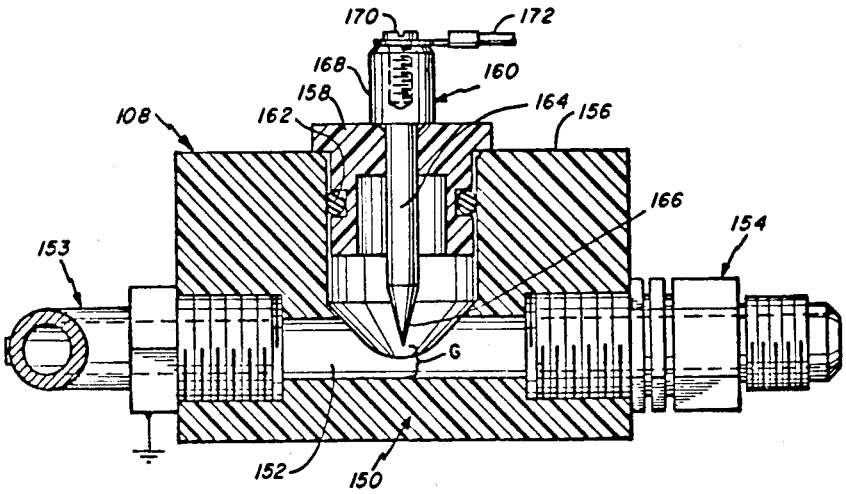
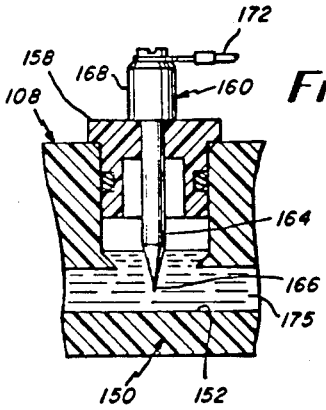
Fig. 4
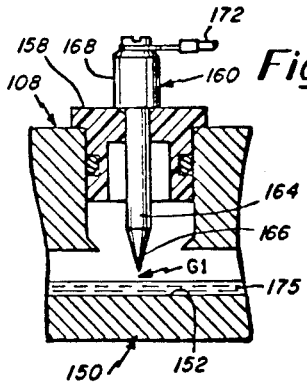
Fig. 5

RIGHT TANK
LEFT TANK
HIGH PROBE
19L
LOW PROBE
17L
OUT OF SYRUP
23L
SOR PROBE
21L
SOR PROBE
21R
HIGH PROBE
19R
LOW PROBE
17R
OUT OF SYRUP
23R
-13V
R8 100KΩ
R9 100KΩ
R10 75KΩ
R4 100KΩ
R1 100KΩ
R2 100KΩ
R3 75KΩ
C5 .01μf
C6 .01μf
C7 .01μf
C1 .01μf
C2 .01μf
C3 .01μf
C4 .01μf
U3
U4
U1
U2
4093B
4011B
IC4
12
14
16
18
20
22
24
26
32
34
36
38
40
42
44
25L
25R
TO K3 FIG. 6B
TO R6 FIG. 6B
TO K2 FIG. 6B

FROM REF. 20 FIG. 6A
FROM REF. 26 FIG. 6A
FROM REF. 40 FIG. 6A
K3
K2
R11 39Ω
C10 .02μf
R5 39Ω
C8 .02μf
R6 1.5KΩ
Q1 MPS6560
71
N.O.
N.C.
55
53
56
54
N.O.
N.C.
59
61
60
58
66
68
K1A
POWER NEUTRAL
70
D5 1N4001
K1
-13V
Z1 1N964
Q2 TIP 30
R7 390Ω
C9 220μf
D1 1N4001
D2 1N4001
D3 1N4001
D4 1N4001
65
T1
S
P
115V
230 V
115V
52
50
HI LINE

SYRUP SENSOR FOR DISPENSING MACHINE

This application is a continuation of application Ser. No. 590,994, filed Mar. 19, 1984, now U.S. Pat. No. 4,645,095.

BACKGROUND OF THE INVENTION

The present invention relates very generally to liquid dispensing machines such as a beverage dispensing machine. More particularly, the invention pertains to a sensor for detecting an out-of-syrup condition, particularly in association with a dispensing machine that dispenses a liquid comprised of water and a flavored concentrate syrup which is adapted to be mixed with the water. In this regard, reference may be made to copending application Ser. No. 590,992 filed Mar. 19, 1984, now U.S. Pat. No. 4,645,095 which relates to an automatically controlled apparatus for providing for self-fill of the tank of the dispensing machine, particularly such a machine that dispenses a liquid comprised of water and a flavored concentrate syrup.

Presently existing syrup probe sensors have not operated totally effectively and sometimes have provided false readings. This has been due, to a large measure, to the lack of compensation for different types of liquids that are being sensed. For example, highly acidic concentrates are very conductive and therefore have a low resistance. Conversely, highly sugared syrups are poor conductors and have a high resistance. In the past, probes have been fine tuned by the use of a potentiometer to operate within a range of the particular fluid being monitored.

An example of a prior art syrup probe sensor is illustrated herein in FIG. 7. FIG. 7 shows a sensor housing 2 which may be constructed of a plastic non-conducting body and, supported therein, stainless steel fittings 3 and 4. A resistance is measured between the fittings 3 and 4 as illustrated by the electrical polarity signals indicated in FIG. 7. It is noted in FIG. 7 that even when out of syrup, a conductive film 5 remains. Particularly, when the syrup is thick, the film is appreciable and conductive. With the arrangement of FIG. 7, the film was very slow in dissipating or draining away and sometimes remained even after a long period of time. Hence, it was very difficult to obtain a clean shut-off or pick up of the out-of-syrup condition. Even with the use of a variable resistor to try to accommodate various syrups, the operation was still unreliable and unpredictable.

Accordingly, it is an object of the present invention to provide an improved means for sensing syrup or the like concentrate being delivered to a storage tank in which it is mixed with water.

Another object of the present invention is to provide an improved out-of-syrup sensor which is adapted to operate effectively regardless of the type of syrup concentrate that is being used.

Still another object of the present invention is to provide an improved out-of-syrup sensor for use with a dispensing machine that dispenses concentrate beverages and in which the out-of-sensor apparatus operates so as to prevent false indications.

Another object of the present invention is to provide an improved out-of-syrup sensor which is of more simplified construction eliminating the need for external trimming components such as potentiometers.

SUMMARY OF THE INVENTION

To accomplish the foregoing and other objects, features and advantages of the invention, there is provided a sensor apparatus for sensing an out-of-syrup condition in a dispensing machine having a storage reservoir for the syrup and fluid lines coupling from the storage reservoir to the beverage tank of the dispenser. The sensor apparatus is disposed in said fluid line and comprises a housing having a through passage from one side to the other thereof. This passage intercouples with said fluid line. Means are provided defining a hole in the housing. Within the housing is disposed a probe, and a means supporting the probe in the hole extending at least in part into the through passage and disposed substantially transversely to the through passage. A gap is defined between the probe and a wall of the through passage whereby syrup breaks from the probe in an out-of-syrup condition causing a gap between the probe and the syrup thus in turn causing the sensor to be in its high resistance state. It is also preferred that the probe be disposed vertically or substantially vertically so that the syrup can break quickly from the probe and quickly indicate a high resistance state indicative of an out-of-syrup condition.

BRIEF DESCRIPTION OF THE DRAWINGS

Numerous other objects, features and advantages of the invention should now become apparent upon a reading of the following detailed description taken in conjunction with the accompanying drawing, in which:

FIG. 3 is a cross-sectional view taken along line 3—3 of FIG. 2 showing the construction of the out-of-syrup sensor of the present invention;

FIG. 4 is a fragmentary view of the sensor of FIG. 3 illustrating the condition when sufficient syrup is flowing through the sensor;

FIG. 5 is a fragmentary view of the sensor of FIG. 3 indicating an out-of-syrup condition;

DETAILED DESCRIPTION

Figure 1:
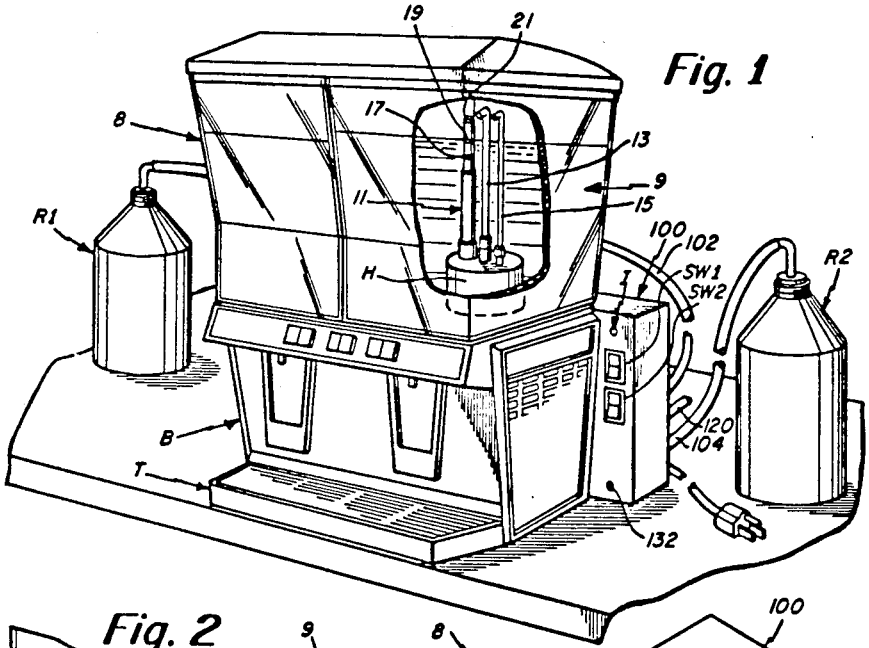
FIG. 1 is a front perspective view of a twin tank dispensing machine with one of the tanks partially cut away to illustrate a probe assembly.
Figure 2:
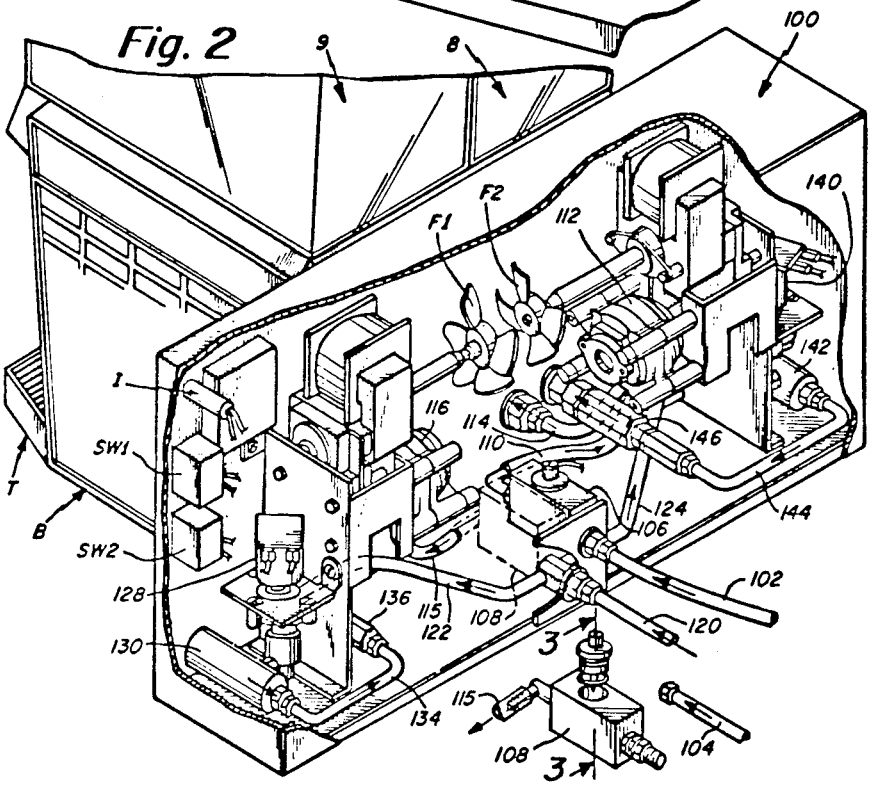
FIG. 2 is rear perspective view showing the out-of-syrup sensor exploded away from the dispensing machine.
Figure 6A:
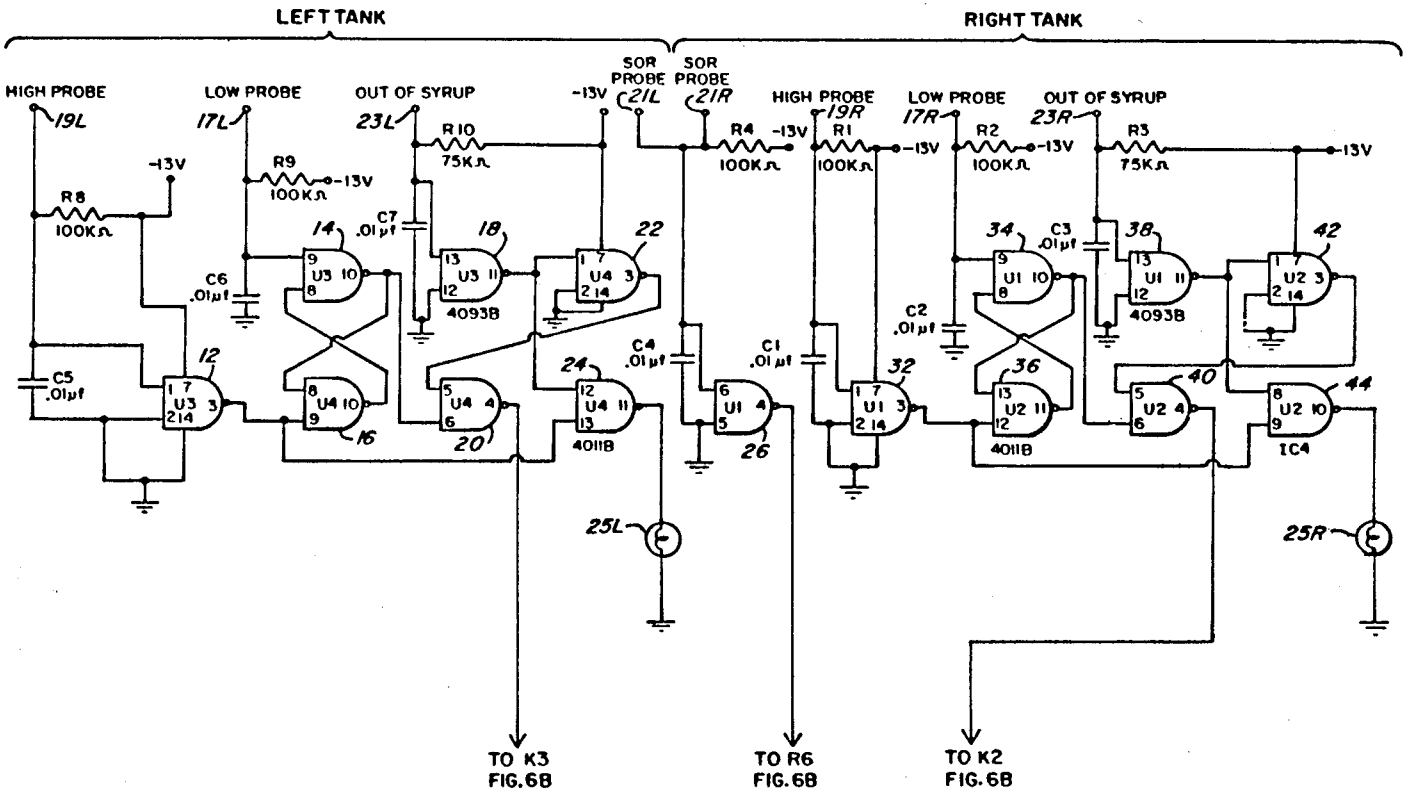
FIGS. 6A and 6B illustrate logic control circuitry in connection with a dispensing machine and illustrating the control associated with the out-of-syrup sensor.
Figure 6B:
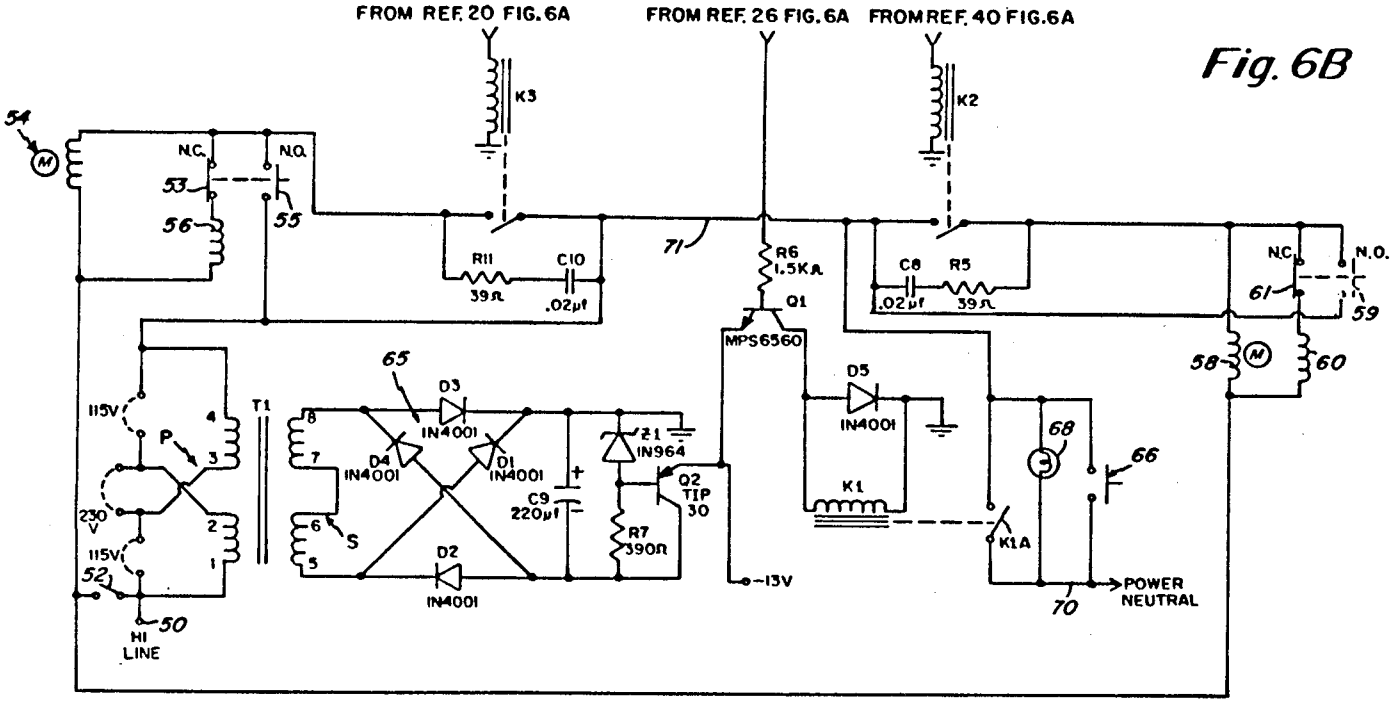

With reference to the drawings, there is depicted in FIGS. 1 and 2, views of the dispensing machine with which the concepts of the present invention may be practiced. The details of the out-of-syrup sensor are illustrated in FIG. 3. FIGS. 4 and 5 show fragmentary views illustrating different conditions; in FIG. 4 a condition in which there is syrup in the sensor and a condition in FIG. 5 in which there is essentially an out-of-syrup condition. FIGS. 6A and 6B show logic control circuitry which in part is associated with the out-of-syrup sensor probe.

FIGS. 6A and 6B show logic control circuitry for providing automatic self-fill but also illustrating the manner in which the out-of-syrup sensor couples to the circuitry for in particular interrupting operation thereof when an out-of-syrup indication is generated. A portion of the control circuitry may be separated into two sections; one associated with a left liquid tank 8 and the other associated with a right liquid tank 9. Each of these tanks has associated therewith, multiple probes, the physical arrangement of which is depicted primarily in FIG. 1. In this regard, there is provided in each tank a support post 11 disposed adjacent to the two fill pipes 13 and 15. These fill pipes are for, respectively, receiving water and the syrup concentrate. On the support post 11 there are provided probe rings including a low probe ring 17, a high probe ring 19, and a top probe cap 21 which is for a system override function. In connection with the control circuitry, the different probe rings are identified at the input control terminals by like reference characters in FIGS. 6A and 6B. In addition, there is also provided an out-of-syrup probe 23 which operates to provide an indication when the main syrup reservoir is empty.

A discussion follows of the operation of FIGS. 6A and 6B at least with respect to the operation of the out-of-syrup sensor. However, reference is now made to FIG. 1 which shows the dispensing machine with its base B and associated drip tray T upon which a cup can rest under either one of the dispensing nozzles. There is, of course, a dispensing nozzle associated witn each of the tanks 8 and 9. Also depicted in FIG. 1 is a first syrup concentrate reservoir R1 and a second syrup concentrate reservoir R2. FIG. 1 also illustrates an indicator I and switches SW1 and SW2. The indicator I is an out-of-syrup light. The switch SW1 is a prime switch. The switch SW2 (switch 52 in FIG. 6B) is a power switch for enabling automatic filling. The operation of these switches are discussed in further detail in connection with the aforementioned copending application.

As mentioned previously, the probe assembly generally comprises fill pipes 13 and 15 along with the support post 11. The fill pipes and the support post 11 are all mounted from the evaporator coil housing H which, of course, contains evaporator coils. The construction of the evaporator section is well known and is not described in any further detail herein. The majority of the probe assembly is made of an insulating dielectric material with the exception of the probe contacts which are conductive. A filament material such as epoxy may be used to seal the parts comprising the support post 11 and associated probe rings or probe cap.

FIG. 2 shows further details of the rear of the dispenser which includes a housing 100 for containing and supporting many of the components used in completing the system. Previously, reference has been made to the syrup reservoirs R1 and R2. The line 102 couples from the syrup reservoir associated with the left tank while line 104 couples from the syrup reservoir associated with the right tank. The line 102 connects to a left tank syrup sensor 106 while the line 104 couples to a right tank syrup sensor 108. Basically, each of the probe electrodes 23L and 23R in sensors 106 and 108, respectively, detects the presence of syrup in the respective lines 102 and 104. When the reservoirs are out of syrup then the out-of-syrup sensors give an indication of such, which is coupled to the circuitry shown in FIGS. 6A and 6B and discussed in some detail hereinafter.

From sensor 106 there is a line 110 which couples to the left tank peristaltic pump 112. A further line 114 connects from the output of the pump to the left tank to the syrup fill pipe 15L. Similarly, the output of the sensor 108 couples by way of a line 115 to the peristaltic pump 116 associated with the right hand tank. A further line not shown in FIG. 2 couples from the output of the pump 116 to the syrup fill tube 15R located in the right hand tank 9.

A water inlet is shown in FIG. 2 at water line 120. This line splits into lines 122 and 124. The line 122, for example, couples to the solenoid valve 128. The output of the solenoid valve 128 couples to a water flow control device 130. Associated with the water flow control device 130 is a water adjustment 132 shown in FIG. 1. This is used to adjust the volume of water flow to the output line 134 and the check valve 136. The water then enters the water fill tube 13R and then enters the right tank 9.

On the left hand side there is a similar set up in which the line 124 couples to the solenoid valve 140. The output of the solenoid valve 140 couples to the water flow control device 142 which also has an associated water adjustment on the front panel. The output line 144 couples from the output of the water flow control device 142 to the check valve 146 and from there to the water fill pipe 13L in the left tank.

There are basically two reasons for the above described fill apparatus. One is interested in maintaining a sanitary environment and is thus concerned with any back siphoning of a beverage into a water line if the supply line pressure fails and a vacuum occurs. If a below level entry were used, a product could be drawn into the water line, unless a highly restrictive and expensive double ball valve were employed. In case the operator forgets to replace the inlet lines, a single ball check valve is located at the inlet to the unit.

A second reason for the above-beverage level inlets for water and syrup is the ease that the Brix or water syrup ratio is checked. One can merely place a bifurcated measuring cup under the syrup and water line outlets and catch the water and syrup flow, or catch both in a single glass and check the Brix with a refractometer. Brix adjustment is easily made by adjusting the water flow screw, such as the screw 132 shown in FIG. 1, located at the bottom front on each side of the unit. Control via screw 132 controls the water/syrup ratio by permitting more or less water flow during the filling sequence.

Also depicted in FIG. 2 are a series of fans F1 and F2 which are used for cooling the pump motor. Also shown are switches SW1 and SW2 along with the indicator I. In addition to the switches and indicators shown in FIGS. 1 and 2, on the opposite or left hand side of the unit there is also an indicator associated with an out-of-syrup sensor associated with the reservoir R1. Tnere is also a pair of switches on that side including a prime switch associated with the left tank and the reset switch. There is also a water flow adjustment port associated with the left tank in the same position as the adjustment 132 shown in FIG. 1 but on the corresponding side of the dispensing machine.

A dispensing unit includes at least four switches, two on each side, such as depicted by switches SW1 and SW2 in FIGS. 1 and 2. As will be described hereinafter, the reset switch comprises a portion of the system override circuitry which shuts cown the unit if the beverage level rises to the system override probe cap 21. The logic in the system override circuit also deactivates the unit after a power failure and, of course, when the unit is first plugged in and started. For the moment it is assumed that the system override circuit has been reset and the power supply is energized.

The circuit diagram also shows the high line 50 coupling to a transformer T1 which has a primary winding P and a secondary winding S. The output from the secondary winding couples to a full wave rectifier bridge circuit 65 comprised of diodes D1–D4. The output from this circuit couples to filter capacitor C9 and to the zener diode Z1, resistor R7 and transistor Q2. A sufficient DC voltage is established at the base of transistor Q2 so as to enable transistor Q2 to be conductive. Basically the power supply may be considered as an emitter follower circuit driven by a zener diode shunt regulator. Further assuming that the system override function has not taken place, then transistor Q1 is also conductive; this then provides power to the relay K1 which has a diode D5 coupled thereacross. The circuit diagram also shows a momentary action reset switch 66 and an associated indicator lamp 68. This may be a neon discharge lamp with a series resistor. The power neutral at line 70 couples to both the reset switch 66 and the indicator 68. The line 70 also couples to one side of contact K1A associated with the relay coil K1.

At an initial phase of operation the reset switch 66 is closed to provide a path from the neutral line 70 through line 71 to the primary winding P of the transformer T1. This causes the AC power to be coupled to the rectifier bridge 65 and in turn provides DC power to the transistors Q1 and Q2 causing energization of the relay K1 and closure of its associated contact K1A. This latches the power circuit.

Reference is now made to FIG. 3 which is cross-sectional view of the out-of-syrup sensor of the present invention. In the dispensing machine illustrated, there are actually two sensors, one associated with the left tank and one associated with the right tank. The sensor 108 is illustrated in FIG. 3. FIGS. 4 and 5 show fragmentary views illustrating the operation.

The sensor 108 comprises a body 150 having a through passage 152 therethrough. Associated with the through passage 152 are end coupling members 153 and 154. The coupling members may be of substantially conventional design and as noted in FIG. 2, permit the coupling of flexible tubing to these members.

The housing 150 is constructed of a conductive material and has an opening in its top surface 156 for receiving the support cap 158. The cap 158 may be made of a plastic material and has supported therein the probe 160 and also supports an O-ring 162 which is used to maintain a vacuum seal within the sensor unit. It is noted that in accordance with the invention the device is under a slight vacuum and thus the space at the top of the assembly indicated above the liquid level in FIG. 4 does not fill with liquid. The liquid level is usually disposed in the vicinity of the top of the passage 152 or possibly slightly over that as illustrated in FIG. 4.

The probe 160 is comprised of a needle 164 with a pointed end 166, and a head 168. The probe 160 is preferably constructed of stainless steel. The screw 170 is illustrated tapped into the head 168 for enabling attachment of the wire 172.

It is noted that only the pointed end 166 of the probe extends into the passage 152. However, there is a gap G as noted in FIG. 3 between the very end of the point and the lower wall of the passage 152. The point of the end 166 is approximately at the center line of the passage 152.

The probe illustrated in FIG. 3 operates on a gravity principle and its operation is essentially totally independent of the type of fluid that is being measured. When the fluid path is empty, the film along the walls at the pointed end 166 breaks way from the probe and the resistance rises to infinity. This eliminates the need for a potentiometer as has been used in the past.

In this regard, reference may be made to FIGS. 4 and 5. FIG. 4 shows the probe 160 with its pointed end 166 extending into the syrup 175. The fluid conductivity that the probe measures is to "ground" as provided by metallic tubing, cooling domes, and other metallic parts of the machine that the fluid comes into contact with. The conductivity path is essentially from the wire 172, through the probe 160, through the fluid in the embodiment of FIG. 4, to the housing 150 and from there to coupling and other members that provide a return path to ground.

FIG. 5 illustrates the probe 160 in a position in which the syrup 175 is at the most, only on a relatively thin film at the bottom of the passage 152. FIG. 5 illustrates the gap G1 where the fluid film breaks away from the probe. There may still be a film on the pointed end 166 but the break or gap in the fluid causes the resistance to rise to infinity thus indicating an out-of-syrup condition.

It is to be noted that the gap G illustrated in FIG. 3 is preferably in a range that provides proper operation. If the gap is too small, then there is apt to be a residual amount of syrup at the bottom of the passage 152 which could give a false indication of there still being sufficient syrup when in fact the syrup reservoir is empty. On the other hand, the gap G cannot be too large because alternate false readings could occur by virtue of an intermittent interruption of liquid flow causing a brief break in the liquid contact. Accordingly, as illustrated, the very end of the probe is preferably at the center line of the through passage 152 but may be in a range of from $\frac{1}{4}$ to $\frac{3}{4}$ of the diameter of the passage 152.

Figure 7:
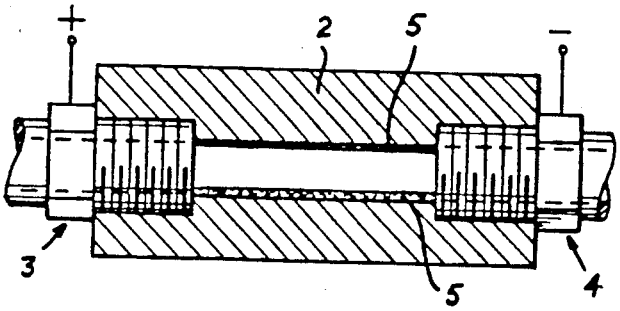
Fig. 7 PRIOR ART
FIG. 7 illustrates a prior art sensor construction.

Thus, it can be seen that in accordance with the present invention a preferred operation occurs by the use of the preferred vertically arranged probe which provides for ready switching to a high resistance state. This operation is in comparison to the prior art illustrated in FIG. 7 in which the thinning of the film was not necessary sufficient to provide a sufficient change in signal that could be readily detected. In the prior art arrangement, the film might have been very slow to break and as a result, inconsistent readings were quite common. However, with the arrangement illustrated in particular, in FIG. 3, as soon as the reservoir is out of syrup, then there is a sufficient break from the probe so that there is an immediate switch to a high resistance state which is readily detected.

Reference is now made to the portion of the control circuitry associated with the left tank 8 and with the relay coil K3. This control circuitry includes gates 12, 14, 16, 18, 20, 22, 24 and a common gate 26. All of these gates are NAND gates. The gates 12, 14, 18 and 26 have associated therewith input capacitors C5, C6, C7 and C4, respectively. These gates provide for Schmitt triggering hysteresis inherent in the 4093 chip that is used. The Schmidt trigger action is provided at the probe input terminals so as to stabilize the logic particularly as the probes gradually dry upon a condition of a receding liquid level. The gates 14 and 16 are cross-coupled to form a binary or flip-flop device.

Thus, the high probe terminal 19L couples to the NAND gate 12; the low probe terminal 17L couples to the NAND gate 14; the out-of-syrup terminal 23L couples to the NAND gate 18; and the override probe 21L couples to the NAND gate 26. It is noted that each of these probe input circuits also includes a resistor such as the respective resistors R8, R9, R10 and R4 each coupling to the negative voltage supply. The NAND gates that are used have a logic low output when both inputs are at a logic high and alternatively they have a logic high output when either or both of the inputs are at a logic low level. In connection with the logic that is described herein the gates are connected to the liquid level probes and the probes are grounded by contact with the liquid. In the absence of the conductive liquid, these probes are driven to the negative voltage such as the −13 volts shown by means of the aforementioned resistors.

In the logic circuit that is depicted the ground level signal corresponds to a logic high or logic "1" and the signal −13 volts corresponds to the logic low or logic "0". The ground voltage has been used for logic high to prevent electrolysis corrosion of the probe electrodes by driving them at a negative voltage with respect to the liquid. The probes are cathodes which are protected by a cathodic protection principle.

In connection with the operation of the control circuit, it may first be considered that, at start-up, there is no liquid in the dispenser (tank). Thus, each of the four liquid sensing probes are ungrounded and the input to each of the corresponding gates 12, 14, 18 and 26 is at its low level (−13 volts). The outputs of these gates are thus at their high level or logic "1" (0 volts). The high output from gate 14 cross-couples to one input from gate 16 and the output from gate 16 is thus low because both of its inputs are high. The high output from gate 14 also couples to gate 20. The high output from gate 18 is converted into a low output at the output of gate 22. This, in turn, causes a high output from the gate 20 which in this logic is a ground signal. This means that the relay K3 is not energized. Also, the gate 24 received at its input two high level signals causing a low at its output which illuminates the indicator light 25L (indicator I in FIG. 2). Thus, at this point in the operation the circuit is in a static state with pump action not having yet commenced.

Each side of the dispensing unit has its individual prime switch, such as the switch SW1 shown in FIG. 2. It also has an out-of-syrup light emitting diode or indicator I which glows red when the syrup sensor is empty of syrup, which occurs when the unit is at initial start-up. To start one side, with the syrup source properly connected, one presses the momentary contact prime switch such as switch SW1 (contacts 53 and 55 or 59 and 61 in FIG. 6B). This starts the pump motor 54 but shuts off the solenoid valve 56 so as not to prefill the bowl with water while the pump is pulling the syrup into the unit. When the syrup fills the syrup sensor, the LED I will go out. The button is released and the unit will fill both syrup and water.

Once the system is manually primed, the out-of-syrup probe 23L is grounded by the syrup. This causes a low output from gate 18 and a high output from gate 22. This thus causes gate 20 to have two high inputs causing its output to go low or to the voltage level of −13 volts. This energizes the relay coil K3 so as to allow syrup pumping and water flow. Relays K2 and K3 each energize both a water flow solenoid and a peristaltic pump when the prime switch is released.

The aforementioned operation causes the liquid to rise in the tank 9 until the liquid contacts the low probe 17L. This causes a high logic level to be coupled to the gate 14 but this does not have any effect on the gate 14 because the other input to gate 14 from the output of gate 16 is low. Thus, the output of gate 14 remains at its high logic level state. This means that both inputs to the gate 20 are still at their high logic level state and thus the low level output from the gate 20 maintains the relay coil K3 energized. Thus, when the tank is being filled with liquid the contact of the low probe 17L in effect causes no action to be taken and the pumping simply continues.

It is to be noted that the fluid conductivity that the various probes measure is to "ground". This conductive path is provided by metallic tubing, cooling domes, and the fill tubes, so that there is, of course, a complete circuit path.

Now, when the high probe 19L is reached the input to the gate 12 goes to its high logic level state and the output of the gate 12 is thus at its low logic level state. This output couples to the gate 16 causing a high output from the gate 16. This high logic output couples back to the input of gate 14 and because the other input to gate 14 is also now high by virtue of the low probe being contacted previously, then the output of the gate 14 goes to its low state. This signal is coupled to the gate 20 for causing the output of the gate 20 to go to its high voltage level state (ground voltage). This de-energizes the relay coil K3. This in turn ceases the filling action as is desired.

When the output of the gate 12 goes to its low level state, this signal is also coupled to the gate 24 causing the output of gate 24 to go to its high state. This causes the LED 25L to cease illumination. The LED 25L illuminates only during the time that both inputs to the gate 24 are high which occurs before reaching the high probe and when out of syrup.

As the liquid is drawn from the tank the liquid level decreases and the liquid level falls below the probe 19L. When that occurs the output of the gate 12 goes high but again this has no effect on the gate 16 and thus the output of the gate 20 is still high maintaining the relay coil K3 de-energized. However, as the liquid level falls, the low probe 17L is eventually uncovered and thus the signal on line 17L to the gate 14 eventually goes low. This resets the bistable device comprised of gates 14 and 16 so that the output of gate 14 goes high. The other input to the gate 20 is also high and thus the output from gate 20 is low. This causes a re-energization of the relay coil K3. This thus turning the liquid pump (and water solenoid) back on. They will remain on until the high probe is contacted, at which time the output from gate 20 goes to its high state again, de-energizing the relay coil K3. This action repeats itself and thus maintains the liquid level thus between the low probe 17L and the high probe 19L.

In addition to these two probes there is also provided an override probe 21L which couples to the corresponding terminal 21L. This input couples to the NAND gate 26 and the output of the NAND gate 26 couples to the base of transistor Q1 by way of resistor R6. The NAND gate 26 functions as an inverter as well as providing Schmitt trigger/driver action.

Normally, the top probe cap 21L is not contacted and thus the output of the gate 26 is high, maintaining the transistor Q1 in conduction. However, if due to a malfunction, the probe cap 21L is contacted, then the output of the gate 26 goes low and the transistor Q1 ceases conduction. The relay K1 is thus de-energized, removing power from the pump motors, solenoids, and logic circuitry.

The control circuit also has an input from the out of syrup sensor indicated at terminal 23L and coupling to the NAND gate 18 which also functions as a inverter. As long as there is syrup in the sensor block 106, the output of the gate 18 is low and the output of gate 22 in turn is high. The high output of gate 22 enables gate 20 and thus as long as the system is not out of syrup the relay K3 is capable of being energized in a selective manner under control from the output of the bistable device which comprises NAND gates 14 and 16 connected in a cross-coupled manner as illustrated.

In the event that the syrup reservoir runs out of syrup, then the terminal 21L is no longer grounded and the input to the gate 18 is thus low. This causes a high output from gate 18 which is inverted by gate 22 to a low output. This low output to gate 20 overrides the other input to gate 20 from the bistable device and causes a high output from gate 20 which in turn de-energizes the relay K3. Thus, in accordance with the present invention there is provided for automatic interruption of any filling in the event that there is a detection that one is in an out-of-syrup state. When one is out-of-syrup then it is not desired to provide any additional pumping into the tank until the syrup can be replenished. In this way the liquid in the tank is not diluted.

The operation of the control circuitry in connection with the right tank is substantially the same as the previous operation described in connection with the left tank. There can be considered at start-up that there is no liquid in the right tank or pump. Thus, each of the four liquid sensing probes associated with the right tank are ungrounded and thus the input to each of the corresponding gates 32, 34, 38 and 26 is at its low level (−13 volts). The outputs of these gates are thus at their high level or logic "1" (0 volts). The high output from gate 34 cross-couples to one input from gate 36 and the output from gate 36 is thus low because both of its inputs are high. The high output from gate 34 also couples to gate 40. The high output from gate 38 is converted into a low output at the output of gate 42. This, in turn, causes a high output from the gate 40 which in this logic is a ground signal. This means that the relay K2 is not energized. Thus, at this point in the operation the circuit is in a static state with filling not having yet commenced.

Once the system is manually primed, the out-of-syrup probe 23R is grounded. This causes a low output from gate 38 and a high output from gate 42. This thus causes gate 40 to have two high inputs causing its output to go low or to the voltage level of −13 volts. This energizes the relay K2 so as to allow fluid pumping and fluid flow.

The aforementioned operation causes the liquid to rise in the tank 9 until the liquid contacts the low probe 17R. This causes a high logic level to be coupled to the gate 34 but this does not have any effect on the output of gate 34 because the other input to gate 34 from the output of gate 36 is low. Thus, the output of gate 34 remains at its high logic level state. This means that both inputs to the gate 40 are still at their high logic level state and thus the low level output from the gate 40 maintains the solenoid coil K2 energized. Thus, when the tank is being filled with liquid the contact of the low probe 17R in effect causes no action to be taken and the pumping simply continues.

Now, when the high probe 19R is reached the input to the gate 32 goes to its high logic level state and the output of the gate 32 is thus at its low logic level state. This output couples to the gate 36 causing a high output from the gate 36. This high logic output couples back to the input of gate 34 and because the other input to gate 34 is also now high by virtue of the low probe being contacted previously, then the output of the gate 34 goes to its low state. This signal is coupled to the gate 40 for causing the output of the gate 40 to go to its high voltage level state or to ground voltage. This de-energizes the solenoid coil K2. This in turn ceases the filling action as is desired.

When the output of the gate 32 goes to its low level state, this signal is also coupled to the gate 44 causing the output of gate 44 to go to its high state. This prevents the LED 25R from illuminating. The LED 25R illuminates when both of the inputs to the gate 44 are high which occurs before reaching the high probe and when out of syrup.

As the liquid is drawn from the tank the liquid level decreases and the liquid level falls below the probe 19R. When that occurs the output of the gate 32 goes high but now this has no effect on the gate 36 and thus the output of the gate 40 is still high maintaining the solenoid coil K2 de-energized. However, as the liquid level falls, the low probe 17R is eventually uncovered and thus the signal on line 17R to the gate 34 eventually goes low. This resets the bistable device comprised of gates 34 and 36 so that the output of gate 34 goes high. The other input to the gate 40 is also high and thus the output from gate 40 is low. This causes a re-energization of the relay coil K2. This thus turns the syrup pump and water solenoid valve back on and remains on until the high probe is contacted, at which time the output of the gate 40 again goes to its high state again de-energizing the relay coil K2. This action repeats itself and maintains the liquid level thus between the low probe 17R and the high probe 19R.

In addition to these two probes there is also provided an override probe 21R which couples to the left override probe 21L and hence may be considered as an extension of that probe, the function of which has already been discussed.

Also, in connection with FIG. 6A it is noted that the gates identified as gates U1 and U3 are 4093 type NAND gates providing Scnmitt trigger action. The other gates such as gates U2 and U4 are standard NAND gates which may be of type 4011. The latter gates are not directly connected to the probes.

The control circuitry depicted herein (particularly in FIG. 6B) also includes a high input power line 50 coupled by way of the power switch 52 to both left and right pumps and solenoids. With regard to the left tank, it is noted that there is provided a pump motor 54 and associated water solenoid valve 56 (note valve 140 in FIG. 5). Similarly, with regard to the right tank there is provided a pump motor 58 and associated water solenoid valve 60 (see valve 128 in FIG. 5). The motors 54 and 58 preferably drive peristaltic pumps (see the pumps 112 and 116 in FIG. 2) that are adapted to pump syrup and operate at a speed of 160 RPM. The water flow is controlled by a 1.0 GPM flow control device and requires 30–35 PSIG flowing pressure to operate.

Having described one preferred embodiment of the present invention, it should now be apparent to those skilled in the art that numerous other embodiments and modifications thereof are contemplated as falling within the scope of the present invention as defined by the appended claims.

What is claimed is:

1. A sensor apparatus for sensing an out-of-syrup condition in a dispensing machine having a storage reservoir for the syrup and fluid lines coupling from the storage reservoir to the beverage tank of the dispenser, said sensor apparatus disposed in said fluid line and comprising; a housing having a through passage from one side to the other thereof, said passage intercoupling with said fluid line, means defining a hole in said housing, a probe, a means supporting said probe in said hole extending at least in part into said through passage and disposed substantially transversely to said through passage, a gap being defined between said probe and a wall of said through passage whereby syrup breaks from the probe providing a gap between the probe and syrup, said probe being disposed substantially vertically so that the syrup may break therefrom by gravity, said probe having an end the extremity of which extends partially into said through passage, means for securing a conductor to the probe, a circuit means and means connecting said circuit means to at least said probe, said circuit means adapted to sense the conductivity at the probe between the probe and syrup, said housing having means defining a same compartment disposed about said probe and over said through passage, pump means connected to said fluid line downstream of said housing to maintain at least a partial vacuum in said small compartment about said probe, said circuit means further comprising means for sensing an increase in resistance at the probe gap.

2. A sensor apparatus as set forth in claim 1 wherein the probe has a tapered end terminating in a tip disposed in the through passage.

3. A sensor apparatus as set forth in claim 2 wherein a portion of the tapered end extends into the small compartment above the through passage.

4. A sensor apparatus as set forth in claim 1 wherein the tip of the probe is at a position relative to the through passage in a range of from $\frac{1}{4}$ to $\frac{3}{4}$ of the diameter of the through passage.

5. A sensor apparatus as set forth in claim 1 wherein said means for supporting the probe comprises a cap disposed in the hole that extends transversely to the through passage.

6. A sensor apparatus as set forth in claim 5 including means for sealng between the cap and the housing.

7. A sensor apparatus as set forth in claim 6 wherein said means for sealing includes an O-ring.

8. A sensor apparatus as set forth in claim 1 wherein the extremity of the tip of the probe terminates at about the center line of the through passage.

9. A sensor apparatus for sensing an out-of-syrup condition in a fluid line coupling a storage reservoir to a beverage tank in a dispensing machine, said sensor apparatus comprising a housing having a through passage from one side to the other thereof for intercoupling with the fluid line, and circuit means responsive to the conductivity of syrup in the sensor characterized by an electrically conductive probe, means supporting the probe in a hole in the housing so as to extend at least in part into said through passage and disposed transversely thereto, a gap being defined between a wall of said through passage and the end of said probe, said probe being so arranged that when disposed substantially vertically the syrup may break therefrom by gravity, means coupling said circuit means to the probe to sense syrup conductivity, and pump means connected to said fluid line downstream of said housing to maintain at least a partial vacuum about said probe.

10. A sensor apparatus as set forth in claim 9 wherein said probe has a pointed end.

11. A sensor apparatus as set forth in claim 9 wherein said means for supporting the probe comprises a cap disposed in the hole.

12. A sensor apparatus as set forth in claim 11 wherein the depth of said hole is greater than the lenght that the cap extends into the hole so as to form between the cap and the through passage a compartment normally under vacuum when syrup is present in the through passage.

13. A sensor apparatus as set forth in claim 12 wherein said probe has a pointed end being disposed in the through passages and a portion of the pointed end extending into said compartment thereabove.

14. A sensor apparatus as set forth in claim 11 wherein the pointed end of the probe is at a position relative to the through passage in a range of from $\frac{1}{4}$ to $\frac{3}{4}$ of the diameter of the through passage.

15. A sensor apparatus as set forth in claim 11 including an O-ring for sealing between the cap and the housing.

16. A sensor apparatus as set forth in claim 9 wherein the extremity of the end of the probe terminates at about the center line of the through passage.

17. A sensor apparatus as set forth in claim 9 wherein said circuit means further comprises means for sensing an increase in resistance at the probe gap to interrupt said pump means.

18. A sensor apparatus as set forth in claim 9 wherein said circuit means includes a trigger means for detecting the conductivity at the probe and operable upon detection of a substantially zero conductivity.

19. A sensor apparatus for sensing an out-of-liquid condition in a fluid line coupling from a storage means to a beverage tank of a dispenser, said sensor apparatus comprising; a housing having a through passage from one side to the other thereof, said passage intercoupling with said fluid line, means defining a hole in said housing, a probe, a means supporting said probe in said hole extending at least in part into said through passage and disposed substantially transversely to at least a segment of said through passage, a gap being defined between said probe and a wall of said through passage whereby liquid breaks from the probe providing a gap between the probe and liquid, said probe being disposed so that the liquid may break therefrom by gravity, said probe having an end the extremity of which extends partially into said through passage, means for securing a conductor to the probe, a circuit means and means connecting said circuit means to at least said probe, said circuit means adapted to sense the conductivity at the probe between the probe and liquid, said housing having means defining a small compartment disposed about said probe and over said through passage, pump means connected to said fluid line to maintain at least a partial liquid vacant space in said small compartment about said probe, said circuit means further comprising means for sensing an increase in resistance at the probe gap.

20. A sensor apparatus as set forth in claim 19 wherein the probe has a tapered end terminating in a tip disposed in the through passage.

21. A sensor apparatus as set forth in claim 20 wherein a portion of the tapered end extends into the small compartment above the through passage.

22. A sensor apparatus as set forth in claim 19 wherein the tip of the probe is at a position relative to the through passage in a range of from $\frac{1}{4}$ to $\frac{3}{4}$ of the diameter of the through passage.

23. A sensor apparatus as set forth in claim 19 wherein said means for supporting the probe comprises a cap disposed in the hole that extends transversely to the through passage.

24. A sensor apparatus as set forth in claim 23 including means for sealing between the cap and the housing.

25. A sensor apparatus as set forth in claim 24 wherein said means for sealing includes an O-ring.

26. A sensor apparatus as set forth in claim 19 wherein the extremity of the tip of the probe terminates at about the center line of the through passage.

27. A sensor apparatus for sensing an out-of-liquid condition in a fluid coupling a liquid storage means to a beverage tank in a dispensing machine, said sensor apparatus comprising a housing having a through passage from one side to the other thereof for intercoupling with the fluid line, and circuit means responsive to the conductivity of liquid in the sensor characterized by an electrically conductive probe, means supporting the probe in a hole in the housing so as to extend at least in part into said through passage and disposed transversely to at least a segment thereof, a gap being defined between a wall of said through passage and the end of said probe, said probe being so arranged that when disposed substantially verticaly the liquid may break therefrom by gravity, means coupling said circuit means to the probe to sense liquid conductivity, and means connected to said fluid line for forcing said liquid through said housing while maintaining at least a partial liquid vacant space about said probe and over said through passage.

28. A sensor apparatus as set forth in claim 27 wherein said probe has a pointed end.

29. A sensor apparatus as set forth in claim 27 wherein said means for supporting the probe comprises a cap disposed in the hole.

30. A sensor apparatus as set forth in claim 29 wherein the depth of said hole is greater than the length that the cap extends into the hole so as to form between the cap and the through passage a compartment normally under vacuum when syrup is present in the through passage.

31. A sensor apparatus as set forth in claim 30 wherein said probe has a pointed end with the pointed end being disposed in the through passages and a portion of the pointed end extending into said compartment thereabove.

32. A sensor apparatus as set forth in claim 29 wherein the pointed end of the probe is at a position relative to the through passage in a range of from $\frac{1}{4}$ to $\frac{3}{4}$ of the diameter of the through passage.

33. A sensor apparatus as set forth in claim 29 including an O-ring for sealing between the cap and the housing.

34. A sensor apparatus as set forth in claim 29 wherein the extremity of the end of the probe terminates at about the center line of the through passage.

35. A sensor apparatus as set forth in claim 27 wherein said circuit means further comprises means for sensing an increase in resistance at the probe gap to interrupt said pump means.

36. A sensor apparatus as set forth in claim 27 wherein said circuit means includes a trigger means for detecting the conductivity at the probe and operable upon detection of a substantially zero conductivity.

37. A sensor apparatus for sensing an out-of-syrup condition in a fluid line coupling a storage reservoir to a beverage tank in a dispensing machine, said sensor apparatus comprising a housing having a through passage from one side to the other thereof for intercoupling with the fluid line, and circuit means responsive to the conductivity of syrup in the sensor characterized by an electrically conductive probe, means supporting the probe in a hole in the housing so as to extend at least in part into said through passage and disposed transversely thereto, a gap being defined between a wall of said through passage and the end of said probe, said probe being so arranged that when disposed substantially vertically the syrup may break therefrom by gravity, and means coupling said circuit means to the probe to sense syrup conductivity, said probe having a pointed end, said means for supporting the probe comprising a cap disposed in the hole, the depth of said hole being greater than the length that the cap extends into the hole so as to form between the cap and the through passage a compartment having a liquid vacant space, said probe having a pointed end with the pointed end being disposed in the through passages and a portion of the pointed end extending into said compartment thereabove.

* * * * *